US008657527B2

(12) United States Patent
Angermann

(10) Patent No.: US 8,657,527 B2
(45) Date of Patent: Feb. 25, 2014

(54) SCREED ARRANGEMENT FOR A ROAD FINISHER

(75) Inventor: Nicole Angermann, Brühl (DE)

(73) Assignee: Joseph Vogele AG, Ludwigshafen/Rhein (DE)

( * ) Notice: Subject to any disclaimer, the term of this patent is extended or adjusted under 35 U.S.C. 154(b) by 0 days.

(21) Appl. No.: 13/152,378

(22) Filed: Jun. 3, 2011

(65) Prior Publication Data

US 2011/0305509 A1 Dec. 15, 2011

(30) Foreign Application Priority Data

Jun. 11, 2010 (EP) ..... 10006094

(51) Int. Cl.
*E01C 19/22* (2006.01)

(52) U.S. Cl.
USPC ..... 404/118

(58) Field of Classification Search
USPC ..... 404/10, 108, 118; 37/274, 284
See application file for complete search history.

(56) References Cited

U.S. PATENT DOCUMENTS

| | | | | |
|---|---|---|---|---|
| 1,773,431 | A * | 8/1930 | Mosel | 404/119 |
| 3,125,935 | A * | 3/1964 | McCandless | 404/118 |
| 3,221,618 | A * | 12/1965 | Hudis | 404/101 |
| 3,417,679 | A * | 12/1968 | Crayton | 404/108 |
| 3,545,349 | A * | 12/1970 | Gottfried et al. | 404/118 |
| 4,379,653 | A | 4/1983 | Brown | |
| 4,682,908 | A * | 7/1987 | Domenighetti | 404/84.1 |
| 4,948,292 | A * | 8/1990 | Haven et al. | 404/84.2 |
| 5,599,135 | A * | 2/1997 | Delaurenti | 404/101 |
| 5,702,202 | A * | 12/1997 | Schleiter | 404/118 |
| 5,921,326 | A * | 7/1999 | Ragule | 172/815 |
| 6,019,544 | A * | 2/2000 | Emerson et al. | 404/104 |
| 6,106,192 | A | 8/2000 | Hargis et al. | |
| 7,121,763 | B1 * | 10/2006 | Young et al. | 404/118 |
| 7,681,337 | B2 * | 3/2010 | Watson | 37/281 |
| 7,824,127 | B1 * | 11/2010 | Shunn et al. | 404/75 |
| 2002/0090263 | A1 * | 7/2002 | Garrity, Jr. | 404/101 |

FOREIGN PATENT DOCUMENTS

| | | |
|---|---|---|
| CN | 2651292 Y | 10/2004 |
| CN | 2926303 Y | 7/2007 |

OTHER PUBLICATIONS

An official action mailed May 2, 2013, which issued in corresponding Chinese Application Serial No. 201110154397.6.

* cited by examiner

*Primary Examiner* — Thomas B Will
*Assistant Examiner* — Abigail A Risic
(74) *Attorney, Agent, or Firm* — Fish & Richardson P.C.

(57) ABSTRACT

The invention relates to a screed arrangement for a road finisher with a basic screed and two extending screeds arranged in front of the basic screed in the laying direction of travel of the road finisher and movable transversely to the laying direction of travel relative to the basic screed. A deflection member is fitted to the basic screed and/or to at least one of the extending screeds and is movable relative to it.

19 Claims, 2 Drawing Sheets

SCREED ARRANGEMENT FOR A ROAD FINISHER

Figure 1:
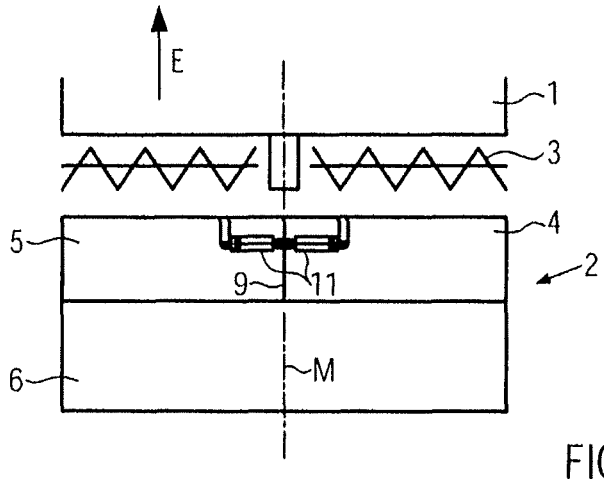

The invention relates to a screed arrangement for a road finisher with a basic screed and two extending screeds arranged in front of the basic screed in the laying direction of travel and movable with respect to the basic screed transversely to the laying direction of travel and having a deflection member fitted on the basic screed and/or on at least one of the extending screeds that is adjustable relative to the screed.

Road finishers for laying concrete or bituminous laying mixture normally have a screed arrangement which is towed behind the road finisher. With this screed arrangement the distributed laying mixture is smoothed and already substantially compacted before the final compaction, for example, using a roller.

It is particularly favourable if the screed has a variable length in a direction transverse to the laying direction of travel of the road finisher in order to be able to obtain different pave widths. For this purpose three different types of screed arrangement have been developed, each of which have different advantages and disadvantages.

In a first type a right and a left extending screed are provided which are located in front of and/or behind a basic screed and which are arranged mutually offset in the laying direction of travel. The advantage of this arrangement is that no paving material is clamped between the two extending screeds when the two extending screeds move towards one another. It is disadvantageous however that the two extending screeds are not arranged symmetrically to one another so that the full pave width is obtained at different points along the laying direction of travel.

With a further type of an extending screed arrangement each of a right and a left extending screed are arranged directly behind a basic screed.

For certain construction site conditions it may be advantageous if the extending screeds are not arranged behind the basic screed, but in front of it, because in this way obstacles such as manholes can be more easily avoided. For this purpose a third type of a screed arrangement is used in which two extending screeds are directly arranged in front of the basic screed. This type of screed arrangement is designated as a front-mounted screed. The invention relates to this third type of screed arrangement.

A disadvantage of the screed arrangements of the front-mounted screed type is that paving material not yet processed is located between the two extending screeds when they move towards one another. This can lead to the paving material becoming clamped between the two extending screeds when a certain spacing between the two extending screeds is undercut. The extending screeds cannot then move closer together.

To avoid this problem, plough structures or deflection members have been developed which are arranged on the inner surfaces of the two extending screeds. Plough structures or deflection members of this nature originate for example from U.S. Pat. Nos. 4,379,653, 6,106,192 A or from the subsequently published European patent application EP 09002132.0. These deflection devices or plough structures displace the laying mixture to the central axis of the screed arrangement or under the basic screed when the two extending screeds move towards one another in order to prevent clamping of the laying mixture between the extending screeds. It is a disadvantage however that the extending screeds can no longer be extended over their full length relative to the basic screed, because the plough structure is not available for integration. Consequently, the extended length of the extending screeds is reduced by the extension of the plough structure transverse to the laying direction of travel.

The object of the invention is to improve a screed arrangement with, where possible, constructively simple means such that, despite effective deflection of the laying mixture when the extending screeds retract, almost the whole length of the extending screeds is available for extension with respect to the basic screed.

The object is solved by a screed arrangement with a basic screed and two extending screeds arranged in front of the basic screed in the laying direction of travel and movable with respect to the basic screed transversely to the laying direction of travel and having a deflection member fitted on the basic screed and/or on at least one of the extending screeds which is adjustable relative to the screed.

With the screed arrangement according to the invention a deflection member, adjustable relative to the basic screed or to the extending screed, is fitted to the basic screed and/or to at least one of the extending screeds. The adjustability of the deflection member contradicts the usual prejudice that the deflection member can only exert the required, high forces on the heavy laying mixture if it is mounted rigidly to the basic screed or to the extending screed. The advantage of the adjustability of the deflection member according to the invention is that the spatial requirement for the deflection member with the extending screeds in the retracted position can be kept very small, so that almost the whole length of the extending screeds is available for extension. The adjustability also enables the deflection member to be brought into a position in which the deflection member actually displaces laying mixture only when the extending screeds are being retracted or even only during a restricted time period during retraction. At other points in time the deflection member does not impair the laying process.

Preferably, the deflection member is arranged on the side of an extending screed facing the other extending screed. At this point the use of the deflection member is particularly effective, because it is precisely here that clamping of laying mixture is otherwise a risk.

It would be sufficient to provide only one deflection member on one of the two extending screeds. However, it is better if a deflection member is provided on each of the extending screeds, because in this way the deflection of the laying mixture occurs uniformly and the individual deflection members have to bear lesser forces.

It is advantageous if the deflection member can be adjusted by means of a drive, in particular by means of a hydraulic drive. A hydraulic drive here has the advantage that it can apply the required forces to hold and adjust the deflection member against the inertia of the heavy laying mixture.

Preferably, the deflection member is adjustable between an adjacent, inactive position on the extending screed or a basic screed and an active position spaced from the relevant screed. In the inactive position the deflection member does not impair the laying process and the relevant screed is comparatively compact. In addition, the spacing of the deflection member from the screed in the active position eases the deflection of laying mixture by the relevant screed.

It is conceivable that the deflection member is adjustable between an inactive position in which it extends parallel to the laying direction of travel and an active position in which it extends at an angle to the laying direction of travel. In the inactive position the deflection member thus does not influence the laying process. In the active position the setting of the deflection member at an angle to the laying direction of travel ensures that the laying mixture is displaced to the central axis of the screed arrangement when the screed arrangement moves in the laying direction of travel.

The deflection of the laying mixture, i.e. the displacement of the laying mixture in the direction of the central axis of the screed arrangement, is particularly effective when the deflection member in the active position is set to an angle of 30° to 55° relative to the laying direction of travel.

Preferably, the deflection member can be continuously adjusted between the inactive and the active positions in order to be able to be particularly well adapted to the varying spacing between the two extending screeds during the retraction of the extending screeds.

It is conceivable that the deflection member can be pivoted on the basic screed and/or is fitted to at least one of the extending screeds. This has the advantage that the deflection member is securely mounted to the relevant screed, for example, by a hinge in order to be able to accept high forces in this way despite an adjustability during the deflection of the laying mixture.

In an alternative embodiment the deflection member comprises one or preferably two deflection plates arranged on the front side of the basic screed in the laying direction of travel. With this embodiment conventional extending screeds can be used, whereas only the basic screed is modified.

It is particularly expedient with this embodiment if the rear inner corners of the extending screeds are bevelled or rounded off to allow movement of the deflection plates. In this way the deflection plates positioned forward of the basic screed are prevented from impairing the retraction of the extending screeds.

It is favourable if the adjustment movement of the deflection member is coupled to the movement of the extending screeds. This coupling could ensure that the extending screeds are brought into the active position during almost the whole retraction movement of the extending screeds. Even more favourable would be if the adjustment movement of the deflection member is coupled proportionally to the movement of the extending screeds.

An automatic coupling of the adjustment movement of the deflection member to the movement of the extending screeds could occur in that a connecting link and/or an electrical or electronic control is provided, or however a mechanical tensioning of the deflection member to the active position.

Finally, the invention relates to a road finisher with a screed arrangement of the type described above.

Figure 2:
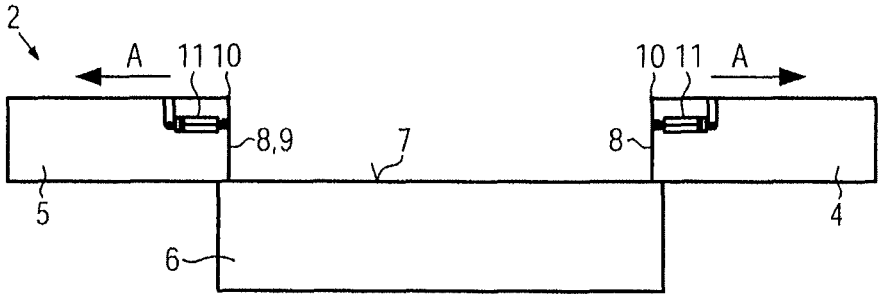
Figure 3:
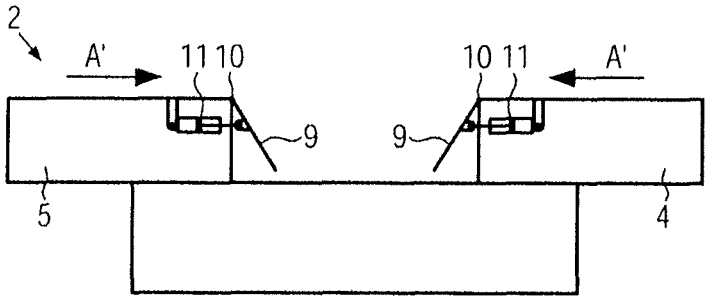
Figure 4:
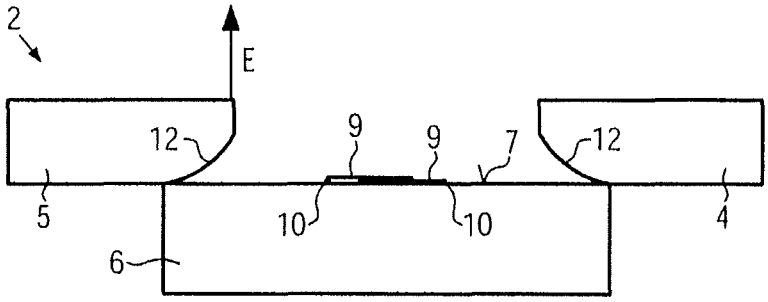
Figure 5:
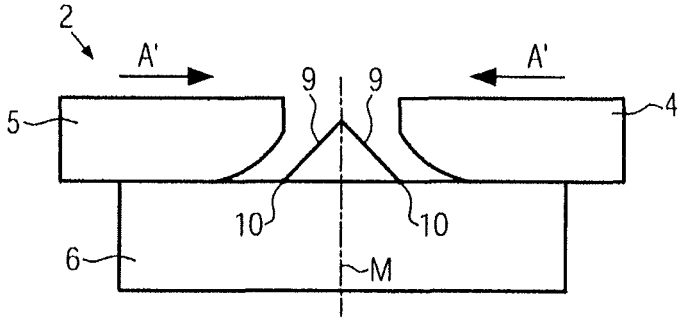
Figure 6:
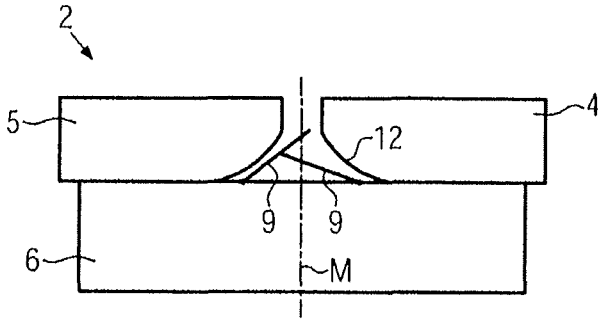

In the following advantageous embodiments of the invention are explained in more detail based on a drawing. The following are shown:

FIG. 1 a first embodiment of a screed arrangement according to the invention with the extending screeds in a retracted position, FIG. 2 the screed arrangement illustrated in FIG. 1 with the extending screeds in an extended position, FIG. 3 the embodiment of a screed arrangement illustrated in FIGS. 1 and 2 during the retraction of the extending screeds, FIG. 4 a second embodiment of a screed arrangement according to the invention with the extending screeds in an extended position, FIG. 5 the screed arrangement illustrated in FIG. 4 during the retraction of the extending screeds and FIG. 6 the embodiment of a screed arrangement illustrated in FIGS. 4 and 5 with still further retracted extending screeds.

In the figures identical components are designated with the same reference numerals throughout.

FIG. 1 schematically shows a road finisher 1 with a screed arrangement 2 according to the invention. The screed arrangement 2 is being towed in the laying direction of travel E behind the tractor unit of the road finisher 1. Between the tractor unit of the road finisher 1 and the screed arrangement 2 there is a transverse spreader device 3, for example two transverse spreader screws, for spreading the laying mixture to be processed over the pave width.

The screed arrangement 2 is of the front-mounted type of screed in which a right extending screed 4 and a left extending screed 5 are arranged in front of a common basic screed 6. The basic screed 6 can be in one piece or consist of several parts. Each of the single screeds 4, 5, 6 has a means of smoothing and compacting laying mixture, for example in the form of smoothing plates or tampers.

With the screed arrangement 2 according to the invention both extending screeds 4, 5 are each directly adjacent to the front side 7 of the basic screed 6. In the laying direction of travel E the two extending screeds 4, 5 are consequently not mutually offset.

In the retracted position of the extending screeds 4, 5 shown in FIG. 1 they contact with their mutually facing inner sides 8 on a (virtual) central axis M of the screed arrangement 2 (whereby a minimum gap between the two extending screeds 4, 5 may also remain). In the direction transverse to the laying direction of travel E the length of an extending screed 4, 5 corresponds approximately to half the length of the basic screed 6.

On the inner side 8 of each extending screed 4, 5, i.e. on the side 8 respectively facing the other extending screed 5, 4, a deflection member 9 is fitted which is adjustable relative to the respective extending screed 4, 5. As can be seen particularly from FIG. 3, the deflection member 9 is in each case a vertically orientated deflection plate, which can be pivoted about a hinge 10 on the front inner edge of the extending screed 4, 5.

In the retracted position of the extending screeds 4, 5 illustrated in FIG. 1 the deflection plates 9 lie adjacently parallel to one another in the laying direction of travel E. To adjust the deflection plates, i.e. to pivot the deflection plates 9 about the relevant hinge 10, a hydraulic drive 11 is provided on each extending screed 4, 5.

FIG. 2 illustrates the screed arrangement 2 with the extending screeds 4, 5 in the extended position. To obtain this position the extending screeds 4, 5 have been moved in the extension direction A, i.e. transverse to the laying direction of travel E with respect to the basic screed 6. In order to realise this movement of the extending screeds 4, 5 suitable drives, for example hydraulic drives, and means of guidance (for example guide rails or guide bars) are provided.

FIG. 2 shows that the deflection members 9, i.e. the deflection plates, remain in their position parallel to the laying direction of travel E. In this way they take up no space or only minimal space transverse to the laying direction of travel E. Consequently, the whole length of the extending screeds 4, 5 is available for extension and the width of the screed arrangement 2 transverse to the laying direction of travel E has (almost) doubled with respect to the position illustrated in FIG. 1.

FIG. 3 shows the screed arrangement 2 during the following retraction of the extending screeds 4, 5, i.e. during a movement of the extending screeds 4, 5 in a direction A' against the extension direction A. The hydraulic drives 11 have been activated manually or automatically, for example by an electronic controller, to move the deflection members 9 from the inactive position illustrated in FIGS. 1 and 2 to an active position. In this active position the deflection members 9 have been pivoted about the hinges 10, so that they are now no longer parallel to the central axis M, but rather extend at an angle of approximately 40° to the central axis. This angle can be between 30° and 55°. If the screed arrangement 2 is now moved in the laying direction of travel E, the deflection members 9 deflect the laying mixture situated between them in the direction towards the central axis M, so that this laying mixture cannot be clamped between the two extending screeds 4, 5 which are approaching one another.

The deflection members 9 can maintain their active position illustrated in FIG. 3 until the extending screeds 4, 5 have moved far enough towards one another that the deflection members 9 contact one another. From this point in time the deflection members 9 are gradually pivoted back to their inactive position by the hydraulic drives 11 while the extending screeds 4, 5 continue to move towards one another. Thus, the deflection members 9 continually reduce the gap between them so that finally on reaching the retracted position according to FIG. 1 no laying mixture is located between the deflection members 9.

The deflection members 9 can extend over the whole height of the extending screeds 4, 5 or only over a lower region of the extending screeds 4, 5. The deflection members 9 may be formed by the wall of the extending screeds 4, 5 or by additional metal sheet in front of the inner wall.

FIG. 4 illustrates a second embodiment of a screed arrangement 2 according to the invention. In this embodiment, in contrast to the first embodiment, the deflection members 9 formed as metal sheets or deflection plates are not arranged on the extending screeds 4, 5, but rather on the front side 7 of the basic screed 6. The two deflection members 9 are each mounted by a hinge 10 on the basic screed 6, whereby the hinge 10 in turn defines a vertical pivot axis for the deflection members 9.

In the inactive position illustrated in FIG. 4 the two deflection members 9 are located parallel to the front side 7 of the basic screed 6. Each of the two deflection members 9 is somewhat longer than the spacing between the central axis M and the relevant hinge 10. Consequently, the deflection members 9 overlap in front of the basic screed 6. Each of the deflection members 9 can be adjusted by a hydraulic drive 11 which, for better clarity, is not illustrated in FIG. 4.

The rear inner corners 12 of the two extending screeds 4 are rounded off convexly. Alternatively, the corners 12 can also be bevelled. The rounding off or bevelling of the corners 12 ensures that the movement of the extending screeds 4, 5 is not impaired by the deflection members 9.

FIG. 5 illustrates the screed arrangement 2 during the movement of the extending screeds 4, 5 in the retraction direction A', i.e. approaching one another. The deflection members 9 have been brought from their inactive position to their active position in that they have been pivoted forwards about the hinges 10. In the active position the two outer edges of the deflection members 9 are located approximately on the central axis M. In this way the two deflection members 9 together form a plough structure in front of the basic screed 6.

When the extending screeds 4, 5 move still closer to one another, as shown in FIG. 6, the deflection members 9 are gradually folded in so as not to impair the movement of the extending screeds 4, 5. In doing this, the deflection members 9 can slide along the rounded off or bevelled inner corners 12 of the extending screeds 4, 5. It is conceivable that in particular the deflection members 9 here are forcibly returned from the active to the inactive position by the extending screeds 4, 5. One deflection member 9 folds in before the other deflection member so that the two deflection members again overlap each other in the inactive position.

The plough structure formed by the two deflection members 9 ensures that laying mixture located between the two extending screeds 4, 5 is transported from the central axis M outwards when the screed arrangement 2 is moved in the laying direction of travel E.

It is conceivable that in all embodiments of the screed arrangement 2 according to the invention the position of the extending screeds 4, 5 relative to the basic screed 6 and the retraction speed of the extending screeds 4, 5 are acquired by appropriate sensors in order to control the movement of the deflection member 9 based on the measurement data. For example, due to a control of this nature, the deflection member 9 might only then be brought from the inactive to the active position when the extending screeds 4, 5 undercut a minimum spacing to one another. Once a second, specified spacing is undercut, the deflection members 9 can gradually be moved from the active back to the inactive position. Instead of a control for the adjusting movement of the deflection member 9 using the displacement measurement and the retraction speed of the extending screeds 4, 5, this control can also occur solely using a displacement measurement or solely in dependence of the retraction speed of the extending screeds 4, 5. Alternatively, it is conceivable that adjustment of the deflection member 9 is carried out manually by the operator of the road finisher 1 or the movement is mechanically controlled, for example by means of an appropriate connecting link guidance.

A further variant of the invention is when the drive 11 for the deflection member 9 is replaced by a tension directed outwards, for example as exerted by a spring or another tension unit which moves the deflection member 9 from the inactive to the active position. When and as long as the position of the extending screeds 4, 5 allows it, the tension ensures in this case that the deflection member 9 is located in the active position for displacing laying mixture sidewards.

The invention claimed is:

1. Screed arrangement for a road finisher comprising a basic screed and two extending screeds arranged in front of the basic screed in the laying direction of travel and movable with respect to the basic screed transversely to the laying direction of travel and having a movable deflection member fitted on at least one of the extending screeds and in between the extending screeds, the deflection member being configured to displace a laying mixture and being adjustable between an inactive position in which the deflection member lies flat against the end of the at least one of the extending screeds and an active position in which the deflection member extends at an angle from the respective screed, and wherein the adjustment movement of the deflection member relative to the at least one extending screeds is coupled to the movement of the extending screeds.

2. Screed arrangement according to claim 1 wherein the deflection member is arranged on the side of an extending screed facing the other extending screed.

3. Screed arrangement according to claim 1, wherein each of the extending screeds is provided with a deflection member.

4. Screed arrangement according to claim 1, wherein the deflection member can be adjusted by means of a hydraulic drive.

5. Screed arrangement according to claim 2 wherein the deflection member is adjustable between an inactive position in which it extends parallel to the laying direction of travel and an active position in which it extends at an angle to the laying direction of travel.

6. Screed arrangement according to claim 5 wherein the deflection member in the active position extends at an angle of 30.degree. to 55.degree. relative to the laying direction of travel.

7. Screed arrangement according to claim 5 wherein the deflection member can be continuously adjusted between the inactive and the active positions.

8. Screed arrangement according to claim 1 wherein the deflection member is fitted pivotably on at least one of the extending screeds.

9. Screed arrangement according to claim 1 wherein the extending screeds have beveled rear inner corners.

10. Screed arrangement according to claim 1 , wherein a connecting link and/or an electronic control is provided to couple the adjustment movement of the deflection member to the movement of the extending screeds.

11. Screed arrangement for a road finisher comprising a basic screed and two extending screeds arranged in front of the basic screed in the laying direction of travel and movable with respect to the basic screed transversely to the laying direction of travel and having a movable deflection member fitted on the basic screed, the movable deflection member being configured to displace a laying mixture and being adjustable between an inactive position in which the deflection member lies flat against the front side of the basic screed and an active position in which the deflection member extends at an angle from the basic screed and between the extending screeds and wherein the adjustment movement of the deflection member relative to the basic screed is coupled to the movement of the extending screeds.

12. Screed arrangement according to claim 11, wherein the deflection member can be adjusted by means of a hydraulic drive.

13. Screed arrangement according to claim 11 wherein the deflection member is adjustable between an inactive position in which it extends parallel to the laying direction of travel and an active position in which it extends at an angle to the laying direction of travel.

14. Screed arrangement according to claim 13 wherein the deflection member in the active position extends at an angle of 30.degree. to 55.degree. relative to the laying direction of travel.

15. Screed arrangement according to claim 13 wherein the deflection member can be continuously adjusted between the inactive and the active positions.

16. Screed arrangement according to claim 11 wherein the deflection member is fitted pivotably on the basic screed.

17. Screed arrangement according to claim 11 wherein the deflection member comprises two deflection plates arranged on the front side of the basic screed in the laying direction of travel.

18. Screed arrangement according to claim 11 wherein the extending screeds have beveled rear inner corners.

19. Screed arrangement according to claim 11, wherein a connecting link and/or an electronic control is provided to couple the adjustment movement of the deflection member to the movement of the extending screeds.

* * * * *